United States Patent [19]

Tanahashi et al.

[11] Patent Number: 4,559,651

[45] Date of Patent: Dec. 24, 1985

[54] HOT-WATER WASHING APPARATUS FOR PERSONAL HYGIENE

[75] Inventors: Takashi Tanahashi, Ikoma; Mitsuo Takai, Nara; Masahito Uemura, Kashihara, all of Japan

[73] Assignee: Matsushita Electric Industrial Co., Ltd., Kadoma, Japan

[21] Appl. No.: 682,512

[22] Filed: Dec. 17, 1984

[30] Foreign Application Priority Data

Dec. 20, 1983 [JP] Japan ..... 58-240117
Mar. 12, 1984 [JP] Japan ..... 59-47453

[51] Int. Cl.[4] ..... A61H 35/00
[52] U.S. Cl. ..... 4/443; 4/420.2
[58] Field of Search ..... 4/420.1–420.5, 4/443–448; 417/199 A, 200

[56] References Cited

U.S. PATENT DOCUMENTS 3,914,804 10/1975 Schrader et al. ..... 4/420.2
4,304,016 12/1981 Oguma et al. ..... 4/420.4
4,304,980 7/1982 Fushimi et al. ..... 4/420.2

*Primary Examiner*—Stephen Marcus
*Assistant Examiner*—Linda J. Sholl
*Attorney, Agent, or Firm*—Spencer & Frank

[57] ABSTRACT

A compact and inexpensive hot-water washing apparatus for personal hygiene which is used for washing the anus or the like after depositing stool in a toilet. By the rotation of an operation shaft 41, the start switch 42 of a pump 27, a flow control valve 30 and an operating valve 35 interlock. The control of the flow rate of the hot water to be supplied to a nozzle 4 for washing the anus or the like and the use of an inexpensive non-self priming pump are enabled by providing a water passage through which the water sucked in from a low level cistern 6 is discharged into a hot-water tank 25 through the operating valve 35 by the pump 27, and a water passage for returning the hot water or water in the hot-water tank 25 through the flow control valve 30 to the suction port 34 of the pump 27. The action of a heat equalizing plate 52 prolongs the duration of hot water jetting of an optimum temperature.

18 Claims, 5 Drawing Figures

HOT-WATER WASHING APPARATUS FOR PERSONAL HYGIENE

BACKGROUND OF THE INVENTION

1. Field of the Invention

This invention relates to a hot-water washing apparatus for personal hygiene which is used for washing the anus or the like after depositing stool in a toilet.

2. Description of the Prior Art

An example of the structure of a conventional hot-water washing apparatus for personal hygiene is shown in FIG. 1. Reference numeral 1 represents a hot-water tank with a heater 2 received therewithin and a nozzle pipe 3 connecting to a nozzle 4. One end of a suction pipe 5 having a filter 7 at its distal end is inserted into a low level cistern 6 disposed in a toilet room, and the other end thereof is connected to a vane pump 9 through a solenoid valve 8. The pump 9 is connected to the bottom portion of the inside of the hot-water tank on the discharge side by a pressure pipe 10. Reference numeral 11 denotes a vacuum breaker provided on the upper portion of the hot-water tank 1. A controller 12 controls both the number of revolutions of the vane pump 9 and the opening and closing of the closing valve 8 interlockingly when an operating knob 13 is turned and can change the temperature of hot water which is controlled by a liquid expansion thermostat 15 when a temperature adjusting knob 14 is turned. Reference numeral 16 denotes a ball tap disposed in the low level cistern 6, and 17 a static water level in the standby state.

Operation of this apparatus will be described in the following. When the operating knob 13 is turned, the solenoid valve 8 is opened and the vane pump 9 is rotated. Thereby, the washing water drawn through the filter 7 is fed under pressure to the hot-water tank 1 via the pressure pipe 10, heated by the heater 2 and the resulting hot water is pushed upward to jet out from the nozzle 4. Since the flow rate of the washing water is varied with the number of rotations of the vane pump 9, the optimum flow for a user can be selected by appropriately turning the operating knob 13.

The first thing essential to a hot-water washing apparatus in terms of the washing water supply facility is that the flow rate of washing water jetted should be appropriately adjusted, which is attained in this apparatus, as described above. The second point is that after washing, the outflow of washing water should be completely stopped. In this apparatus, when the operating knob 13 is returned to the stopping position, the vane pump 9 stops and the solenoid valve 8 is closed. Therefore, siphonal action by virtue of the water head between the static water level of the low level cistern 6 and the nozzle 4 can be intercepted, this satisfying the second point. The third point is that the residual water in the nozzle pipe 3 which has been left to cool down during the suspension of the operation should not chill the user by being jetted out at the beginning of washing. The vane pump 9 stops when washing is over and the vacuum breaker 11 is then opened because the inner pressure of the hot-water tank 1 is lowered, whereby the washing water left in the nozzle pipe 3 flows downwardly from the nozzle 4 until the water level in the hot-water tank 1 reaches the inlet of the nozzle pipe 3. Accordingly the washing water does not stay in the nozzle pipe 3 during suspension of the operation, and thus the third condition is also met. The fourth point is that it should be possible for the washing water to be fed under pressure to the hot-water tank 1, even when there is air on the suction side of the vane pump 9. That is, when a hot-water washing apparatus is newly installed or an existing hot-water washing apparatus is used when the water level of the low level cistern 6 is lower than the position of the filter 7 after, for example, the associated toilet stool has been used during suspension of the water supply, air is naturally sucked in from the suction pipe 5. Even when the water supply is recovered and the water level of the low level cistern 6 is returned, the washing water cannot flow normally downwardly due to the water head between the top of the inverted U-shaped suction pipe 5 and the water level. This example solves this problem by using a self-priming vane pump so as to utilize the suction head of the pump when air is in the suction pipe 5.

As described above, this example of the prior art satisfies the four essential conditions from the view point of the washing water supply facility. However, the self-priming vane pump, which needs to be used with variable speed, disadvantageously raises costs in terms of structure, precision in manufacturing, controlling means and so forth.

Further, a certain distance is required between the heater 2 and the inner wall of the hot-water tank 1 in order to insure safety at the time of any abnormality, such as when the liquid expansion thermostat 15 is out of order, or when the apparatus is electrically energized without water being present in the tank 1. Therefore, during heating, though the water above the heating portion of the heater 2 may be sufficiently heated, the temperature of the water between the outer periphery of the heating portion and the inner wall of the hot-water tank 1 or the water below the heater is raised simply as a result of natural convection. This hinders a uniform distribution of temperature in the tank 1, and hence leads to only a small quantity of hot-water of an optimum temperature being prepared, which leads to a rapid drop in the temperature of jetted hot water at the instant when jetting of the water in the lower temperature portion begins, even though hot water of an optimum temperature is jetted from the nozzle 12 at the beginning of washing, as is indicated by a in FIG. 5.

Furthermore, when the apparatus is actually used, further, cold water is supplied forcibly from the bottom part of the hot-water tank 1 such as to stir the hot water in the hot-water tank 1. In this way cold water bypasses the normal step, passes through the nozzle pipe and is jetted out from the nozzle 4. This lowers the temperature of the jetted hot water suddenly, even at the start of jetting. In other words, the duration of jetting out hot-water of optimum temperature is inconveniently very short.

SUMMARY OF THE INVENTION

Accordingly it is an object of the invention to solve the above problems and to provide a hot-water washing apparatus with a compact washing water supply portion in which the duration of hot-water jetting of an optimum temperature is prolonged, and which is favorable in terms of cost reduction.

BRIEF DESCRIPTION OF THE DRAWINGS

The above and other objects, features and advantages of the present invention will become clear from the following description of the preferred embodiment thereof, taken in conjunction with the accompanying drawings.

DESCRIPTION OF THE PREFERRED EMBODIMENT

Figure 2:
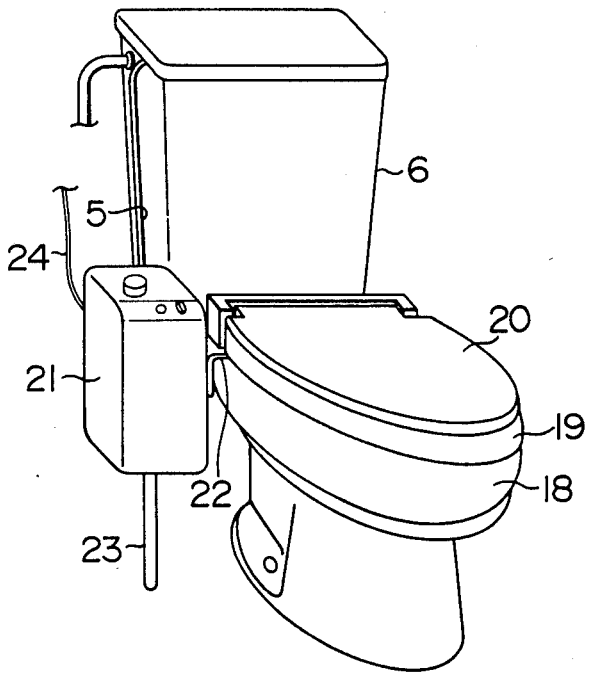
FIG. 2 is a perspective view of an embodiment of a hot-water washing apparatus according to the invention which is attached to a toilet stool.

Referring now to FIG. 2 which shows an embodiment of a hot-water washing apparatus for personal hygiene, reference numeral 18 represents a toilet stool, 20 a cover for the toilet stool 18, and 6 a low level cistern. The washing apparatus is secured to the toilet stool 18 by an L-shaped metal bracket 22 extending from the side surface of the main body 21, and is further supported by a leg 23. Reference numeral 5 denotes a suction pipe 5 provided for supplying water and introducing the water stored in the low level cistern 6 to the inside of the main body 21. Reference numeral 24 represents a cord connected to a power source.

Figure 3:
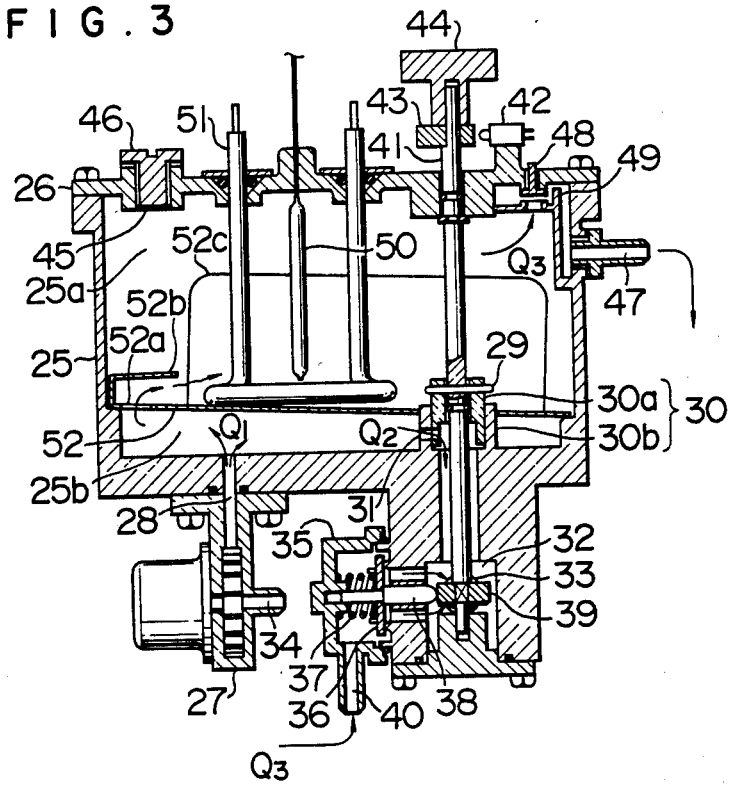
FIG. 3 is a sectional view of the main part of an embodiment of a hot-water washing apparatus according to the invention.

FIG. 3 illustrates the inner structure of the main body 21. Reference numeral 25 is a hot-water tank with a cover 26 fixed thereto. A non-self-priming pump 27 is fixed beneath the bottom of the hot-water tank 25 and is connected by a water passage to a water inlet 28 of the hot-water tank 25 on the discharge side. A flow control valve 30 is disposed at the bottom portion of the inside of the hot-water tank 25 and the divergence of a gate 31 formed by a control valve body **30*a* and a fixed valve body 30*b* is adjusted by the rotation of the control valve body 30*a* which is attached to an operation shaft 41 by means of a pin 29. Reference numeral 32 denotes a connection chamber provided in the lower portion of the hot-water tank 25. The connection chamber 32 is connected to the flow control valve 30 on the outlet side, and a side outlet 33 is connected to a suction port 34 of the pump 27** by a pipe (not shown).

An operating valve 35 is disposed in the lower portion of the hot-water tank 25, and is connected to the connection chamber 32 on the outlet side. A valve body 36 which is horizontally movable is resiliently pressed toward the closing position by a spring 37, and a valve stem 38 engages a first cam 39. The inlet 40 of the operating valve 35 is connected to the filter in the low level cistern 6 via the suction pipe 5 (not shown). The operation shaft 41 is inserted watertightly into the inside of the hot-water tank 25 from the outside thereof, on which are mounted the control valve body **30*a*, the first cam 39 and a second cam 43 which engages a start switch 42 of the pump 27. Reference numeral 44 is an operating knob for the shaft 41**.

Figure 1:
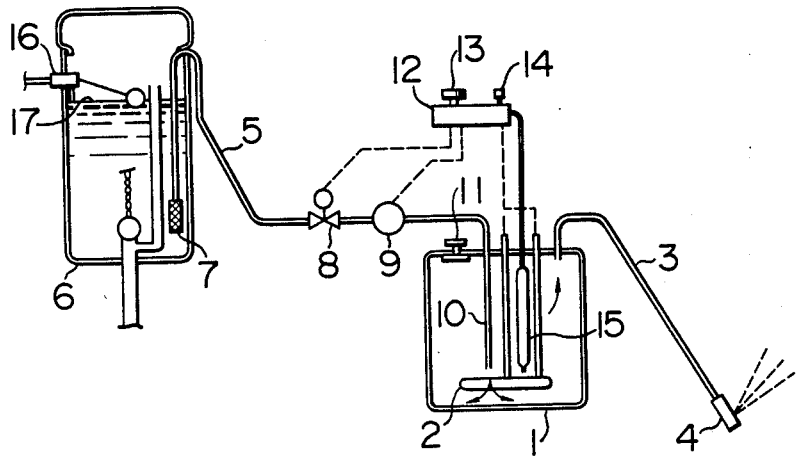
FIG. 1 prior art
FIG. 1 shows the structure of a conventional hot-water washing apparatus for personal hygiene.

Reference numeral 45 represents a water inlet and 46 a plug. A hot-water outlet 47 is connected to a nozzle pipe by a nozzle (not shown), in the same way as is shown in FIG. 1.

Figure 4:
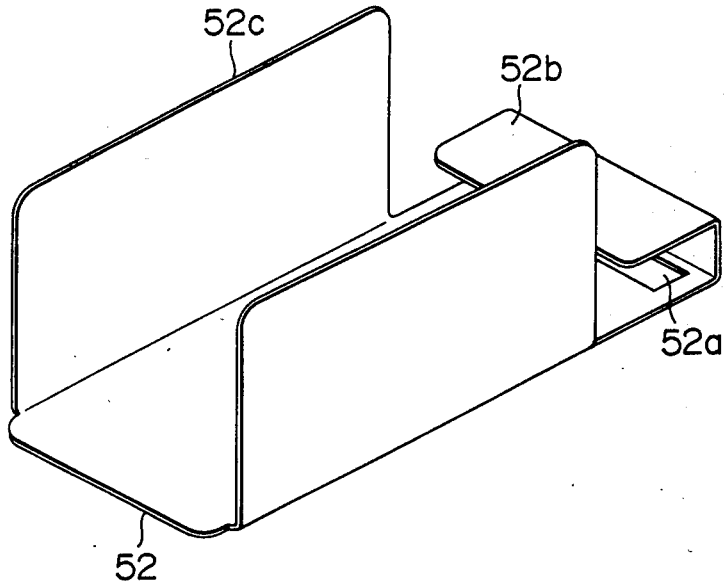
FIG. 4 is a perspective view of a heat equalizing plate.

Reference numeral 48 denotes a vacuum breaker and 49 a dam wall. A liquid expansion thermostat 50 turns a sheathed heater 51 ON or OFF such as to keep the temperature of the hot water at a fixed temperature. A heat equalizing plate 52 is provided slantwise at the bottom portion of the inside of the hot-water tank 25 such as to come into contact with the sheathed heater 51 and to divide the interior of the hot-water tank 25 into an optimum temperature chamber **25*a* and a low temperature chamber 25*b*. FIG. 4 is a perspective view of the heat equalizing plate 52. In FIG. 4, reference numeral 52 represents an opening portion, 52*b* a masking portion, and 52*c*** a side wall portion.

The operation which takes place in the above-described structure will be explained in the following.

In the ordinary standby state, the hot-water tank 25 is filled with washing water and the flow control valve 30 is fully opened, the operating valve 35 is fully closed and the pump 27 is stopped.

When the operation shaft 41 is turned by the operating knob 44, the pump 27 is operated by the start switch 42 engaging the second cam 43, and the operating valve 35 engaging the first cam 39 is opened on being pushed by the valve stem 38. The flow $Q_1$ delivered from the pump 27 strikes against the heat equalizing plate 52 provided in the bottom portion of the hot-water tank 25, and spreads and reduces the flow velocity. Part of it becomes bypass flow $Q_2$ passing through the flow control valve 30, while another part passes through the opening portion **52*a* of the upper part of the slanted heat equalizing plate 52, hits the masking portion 52*b*, flows slowly upwardly in the hot-water tank 25, and is fed to the nozzle 4 to produce jet $Q_3$. ($Q_1-Q_2=Q_3$) Therefore, the quantity of the water delivered from the low level cistern 6 and sucked into the inlet 40 of the operating valve 35** equals $Q_3$.

Since the quantity of the jetted water $Q_3$ fed to the nozzle 4 can be varied by changing the degree to which the gate 31 is opened by the turning of the operating knob 44, the user can select an optimum flow rate of water for washing. When the operation knob 44 is returned to the stop position, the flow control valve 30 is fully opened, the operating valve 35 is fully closed, and the pump 27 is stopped. Accordingly, even if the head of water between the rising portion of the suction pipe 5 and the nozzle 4 is large, the operating valve 35 interrupts the natural downflow of the washing water due to siphonage. In the closing position of the operating valve 35, both the resilient pressure of the spring 37 and the back pressure due to the water head act in the closing direction, whereby effective cutting off of the flow of water is secured all the more efficiently.

If the hydraulic pressure of the hot-water tank 25 is reduced by the stopping of the pump 27, the vacuum breaker 48 is opened, and the water remaining in the portion from the dam wall 49 to the nozzle 4 is discharged from the nozzle 4 due to natural downflow.

Furthermore, when the hot-water washing apparatus is newly installed, an appropriate amount of priming water is poured into the hot-water tank 25 from the water inlet 45 by removing the plug 46. By turning the operating knob 44, the primary water is sucked into the pump 27 through the connection chamber 32, and draws the air contained in the suction pipe to push the same into the hot-water tank 25. After the air is completely removed, normal operation is possible.

In addition, even when the water supply is suspended and air enters the suction pipe 5, operation after the recovery of the water supply expels the air and enables a normal operation.

As described above, according to the invention, the pump 27 and the operating valve 35 are directly connected to the hot-water tank 25, the flow control valve is accommodated in the hot-water tank 25, and the operation shaft 41 is provided such as to penetrate the hot-water tank 25 and to cause each of the pump 27, the operating valve 35 and the flow control valve 30 to engage one another in an interlocking state. Thus, a compact washing water supply portion is realized.

All the portions of the operating valve 35 and the flow control valve 30 which are movable in combination with operation of the apparatus are disposed in the water-sealed chamber in the hot-water tank 25, which prevents any trouble which might be caused by leakage of water.

Further, since in the closing position of the operating valve 35, both the resilient pressure of the spring 37 and the back pressure caused by the water head act in the same direction, closing of the operating valve is more positively effected. In addition, the apparatus does not require any solenoid valves and therefore is compact in construction and inexpensive to manufacture.

Figure 5:
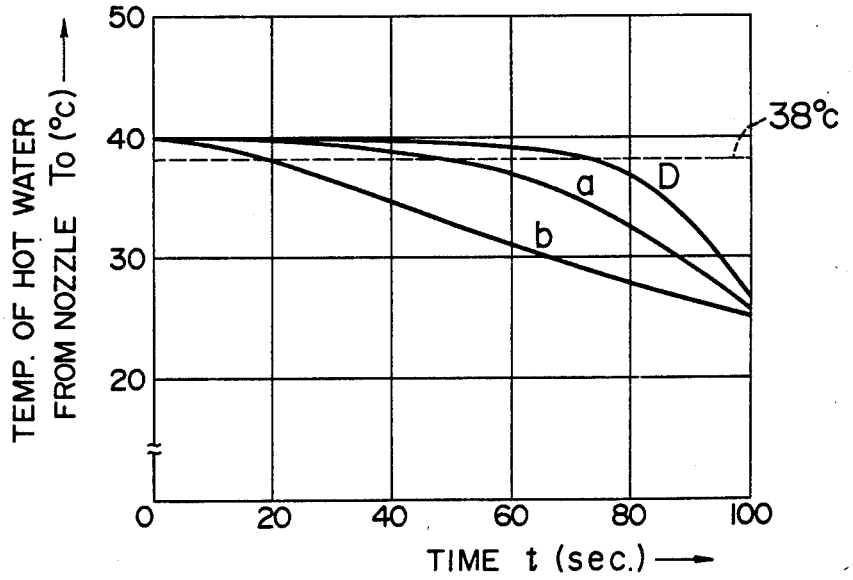
FIG. 5 is a graph showing the change in hot-water temperature at the time of jetting under the condition that the water temperature is 10° and the jetting flow rate is 0.8/h.

In addition, during the time of heating, the heat of the sheathed heater 51 spreads to the entire portion (particularly the upward and downward portions) of the interior of the optimum temperature chamber **25*a* by virtue of the heat equalizing plate 52, particularly by the side wall portions 52*c* on both ends thereof, and equalizes the distribution of temperature in the optimum temperature chamber 25*a*. The heat equalizing plate 52 and the low temperature chamber 25*b* serve as a heat shield at the time of abnormal heating such as when the liquid expansion thermostat 50 is out of order or when the apparatus is energized without water being present in the hot-water tank. This ensures safety even if the sheathed heater 51 and the wall of the hot-water tank 25 are close, which allows the low temperature chamber 25*b* to be made very small, and hence, the optimum temperature chamber 25*a* large so that a large amount of hot water of a uniform temperature remains. On the other hand, during use, the velocity of the water which flows into the low temperature chamber 25*b* is supplied to the optimum temperature chamber 25*a* after the velocity thereof is adequately reduced in the low temperature chamber 25*b* by means of the heat equalizing plate 52. Accordingly, the hot water in the optimum temperature chamber 25*a* is pushed upward without being stirred. All of these factors described above result in beneficial effects on the duration of hot water jetting of an optimum temperature, as is indicated by D in FIG. 5**.

As has been described in detail, a hot-water washing apparatus according to the invention controls the number of revolutions of a conventional pump by using a flow control valve and an operating valve of very simple structure and an inexpensive non-self-priming pump and realizes a function similar to a hot-water washing apparatus which uses a self-priming vane pump by employing a solenoid valve. In addition, the duration of hot water jetting of an optimum temperature is prolonged due to the effect of the heat equalizing plate. In other words, this invention can provide a compact, inexpensive and pleasant hot-water washing apparatus, and thus it is very valuable for exploitation in industry.

While there has been described what is at present considered to be a preferred embodiment of the invention, it will be understood that various modifications may be made therein, and it is intended that the appended claims cover all such modifications as fall within the true spirit and scope of the invention.

What is claimed is:

1. A hot-water washing apparatus for personal hygiene comprising:

a hot-water tank receiving a heater therein;

a nozzle connected to the hot water outlet of said hot-water tank;

a water supply pipe for supplying water to the water inlet of said hot-water tank;

an operating valve, a connection chamber and a pump which are provided between said water supply pipe and said water inlet in that order;

said connection chamber being provided below said hot-water tank;

a flow control valve which is connected to the bottom portion of said hot-water tank on the inlet side and connected to said connection chamber on the outlet side;

an operation shaft which is inserted into said hot-water tank from the outside thereof and to which said flow control valve is connected;

a first cam which is mounted on said operation shaft and is engaged with said operating valve; and a second cam which is mounted on said operation shaft and which is connected to the start switch of said pump.

2. A hot-water washing apparatus for personal hygiene according to claim 1, wherein said pump is provided below said hot-water tank.

3. A hot-water washing apparatus for personal hygiene according to claim 1, wherein said apparatus is designed such that when said operating valve is in the closed state said flow control valve is in the opened state.

4. A hot-water washing apparatus for personal hygiene according to claim 2, wherein said apparatus is designed such that when said operating valve is in the closed state said flow control valve is in the opened state.

5. A hot-water washing apparatus for personal hygiene comprising:

a hot-water tank receiving a heater therein;

a nozzle connected to the hot water outlet of said hot-water tank;

a water supply pipe for supplying water to the water inlet of said hot-water tank;

an operating valve, a connection chamber and a pump which are provided between said water supply pipe and said water inlet in that order;

said connection chamber being provided below said hot-water tank;

a spring which is provided in said operating valve and designed such that the back pressure and the resilient pressure acting on the valve body of said operating valve acts in the closing direction of said valve body;

a flow control valve which is connected to the bottom portion of said hot-water tank on the inlet side and connected to said connection chamber on the outlet side;

an operation shaft which is inserted into said hot-water tank from the outside thereof and to which said flow control valve is connected;

a first cam which is mounted on said operation shaft and is engaged with said operating valve; and a second cam which is mounted on said operation shaft and which is connected to the start switch of said pump.

6. A hot-water washing apparatus for personal hygiene according to claim 5, wherein said pump is provided below said hot-water tank.

7. A hot-water washing apparatus for personal hygiene according to claim 6, wherein said apparatus is designed such that when said operating valve is in the closed state said flow control valve is in the opened state.

8. A hot-water washing apparatus for personal hygiene according to claim 5, wherein said apparatus is designed such that when said operating valve is in the closed state said flow control valve is in the opened state.

9. A hot-water washing apparatus for personal hygiene comprising:

a hot-water tank receiving a heater therein;

a nozzle connected to the hot water outlet of said hot-water tank;

a water supply pipe for supplying water to the water inlet of said hot-water tank;

an operating valve, a connection chamber and a pump which are provided between said water supply pipe and said water inlet in that order;

said connection chamber being provided below said hot-water tank;

a flow control valve which is connected to the bottom portion of said hot-water tank on the inlet side and is connected to said connection chamber on the outlet side;

an operation shaft which is inserted into said hot-water tank from the outside thereof and to which said flow control valve is connected;

a first cam which is mounted on said operation shaft and is engaged with said operating valve;

a second cam which is mounted on said operation shaft and which is connected to the start switch of said pump; and a heat equalizing plate of a material of good thermal conductivity which is provided between the lower surface of said heater and the bottom surface of said hot-water tank such as to extend substantially horizontally and which has side walls erect along the inner side walls of said hot-water tank.

10. A hot-water washing apparatus for personal hygiene according to claim 9, wherein said pump is provided below said hot-water tank.

11. A hot-water washing apparatus for personal hygiene according to claim 10, wherein said heat equalizing plate has an inclination in the state in which it is attached to said hot-water tank, and an opening portion is provided on the upper part of said inclination.

12. A hot-water washing apparatus for personal hygiene according to claim 9, wherein said apparatus is designed such that when said operating valve is in the closed state said flow control valve is in the opened state.

13. A hot-water washing apparatus for personal hygiene according to claim 12, wherein said heat equalizing plate has an inclination in the state in which it is attached to said hot-water tank, and an opening portion is provided on the upper part of said inclination.

14. A hot-water washing apparatus for personal hygiene according to claim 9, wherein said side walls are provided on both ends of said heat equalizing plate.

15. A hot-water washing apparatus for personal hygiene according to claim 14, wherein said heat equalizing plate has an inclination in the state in which it is attached to said hot-water tank, and an opening portion is provided on the upper part of said inclination.

16. A hot-water washing apparatus for personal hygiene according to claim 9, wherein said heater and said heat equalizing plate abut each other.

17. A hot-water washing apparatus for personal hygiene according to claim 16, wherein said heat equalizing plate has an inclination in the state in which it is attached to said hot-water tank, and an opening portion is provided on the upper part of said inclination.

18. A hot-water washing apparatus for personal hygiene according to claim 9, wherein said heat equalizing plate has an inclination in the state in which it is attached to said hot-water tank, and an opening portion is provided on the upper part of said inclination.

* * * * *